US006799514B2

(12) United States Patent
Boatman et al.

(10) Patent No.: US 6,799,514 B2
(45) Date of Patent: Oct. 5, 2004

(54) CLEANING APPARATUS FOR PRINTING PRESS

(75) Inventors: Donn Nathan Boatman, Florence, KY (US); George Vincent Wegele, Fairfield, OH (US); Krista Beth Comstock, Mason, OH (US); Glen Charles Fedyk, Fairfield Township, OH (US); Mark Edwin Forry, Hamilton, OH (US); David Albert Peterson, Cincinnati, OH (US); Timothy Paul Fiedeldey, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 52 days.

(21) Appl. No.: 10/043,832

(22) Filed: Jan. 11, 2002

(65) Prior Publication Data

US 2003/0205157 A1 Nov. 6, 2003

(51) Int. Cl.[7] ..... B41F 35/00
(52) U.S. Cl. ..... 101/425; 101/424.1
(58) Field of Search ..... 101/423–425, 101/424.1, 487, 488; 134/21, 151; 15/256.5, 256.51, 256, 256.52

(56) References Cited

U.S. PATENT DOCUMENTS

| | | | | |
|---|---|---|---|---|
| 1,703,015 A | | 2/1929 | Ratignier | |
| 3,775,806 A | | 12/1973 | Olbrant et al. | |
| 3,932,910 A | | 1/1976 | Shimoda | |
| 4,872,920 A | * | 10/1989 | Flynn et al. | 134/21 |
| 4,956,271 A | * | 9/1990 | Milone | 432/59 |
| 5,086,701 A | | 2/1992 | Gasparrini et al. | 101/425 |
| 5,202,534 A | | 4/1993 | Tamiya et al. | |
| 5,265,537 A | | 11/1993 | Gasparrini et al. | 101/425 |
| 5,502,788 A | * | 3/1996 | Platsch | 392/424 |
| 5,603,775 A | | 2/1997 | Sjoberg | 134/21 |
| 5,631,832 A | * | 5/1997 | Hagenbuch | 701/35 |
| 5,644,986 A | | 7/1997 | Gydesen | 10/424 |
| 5,657,693 A | | 8/1997 | Kumaki et al. | |
| 5,732,631 A | | 3/1998 | Walther et al. | 101/424 |
| 5,740,739 A | | 4/1998 | Herold et al. | |
| 5,768,993 A | | 6/1998 | Stuart | |
| 5,784,962 A | | 7/1998 | Geis et al. | 101/423 |
| 5,797,327 A | * | 8/1998 | Gieser et al. | 101/483 |
| 5,913,721 A | * | 6/1999 | Teng | 454/66 |
| 5,964,960 A | * | 10/1999 | Boeck | 134/34 |
| 6,053,104 A | | 4/2000 | Marks | 101/425 |
| 6,148,831 A | * | 11/2000 | Lindstrom et al. | 134/21 |

FOREIGN PATENT DOCUMENTS

| | | |
|---|---|---|
| CH | 490967 | 10/1969 |
| DE | 2006716 | 9/1970 |
| JP | 61150113 | 1/1988 |
| JP | 63-004947 | 1/1988 |
| WO | WO 97/00173 | 1/1997 |

* cited by examiner

*Primary Examiner*—Anthony H. Nguyen
(74) *Attorney, Agent, or Firm*—David K. Matheis; Julia A. Glazer; David M. Weirich

(57) ABSTRACT

A cleaning apparatus for a printing press. The cleaning apparatus of the present invention allows for effective removal of contaminants from printing press print plates while the printing press is running. Furthermore, the cleaning apparatus of the present invention effectively applies and removes cleaning fluids such as water from the printing plate without resulting in the formation of water drops and streaks on the printed substrate.

16 Claims, 11 Drawing Sheets

CLEANING APPARATUS FOR PRINTING PRESS

TECHNICAL FIELD

This invention relates to a cleaning apparatus for cleaning printing press plates.

BACKGROUND OF THE INVENTION

Applying images to substrates by utilizing pigment or dye based ink compositions is well known in the art. These images are generally applied for the purpose of making the article more aesthetically pleasing to the consumer.

One of the difficulties historically experienced with printed substrates that are printed with pigment based ink compositions is the tendency for the ink to rub-off of the surface of the paper upon exposure of the paper to liquids. This problem is even more pronounced for printed substrates printed with inks exhibiting relatively high color densities. This problem can be further compounded when printing on absorbent disposable paper products (nonlimiting examples of which include facial tissue, bath tissue, table napkins, wipes, diapers, woven disposable fabrics, nonwovens, wovens, cotton pads, and the like). Absorbent disposable paper products tend to produce more lint and associated contaminants than other grades of paper.

One way to control ink rub-off from the surface of the printed substrate is to utilize rub resistant inks. These inks tend to adhere much better to the surface of the substrate. However, one of the drawbacks associated with using rub resistant inks relates to printing press hygiene. Inks that adhere well to the substrate often exhibit similar properties when in contact with the printing press. In particular, the print plates tend to accumulate ink and paper fiber deposits that can eventually lead to print defects in the printed substrate. In order to prevent print defects more frequent cleaning of the printing press is necessitated. This can lead to reduced printing process efficiency. This is especially true in instances where printing press production has to be halted while the printing press is cleaned. Printing press cleaning devices are generally designed to be utilized either while the press is shut down or while the press is running (i.e.; on-line cleaning).

Prior art printing press plate cleaning devices have commonly utilized air, vacuum, cleaning fluids, brushes, and other mechanical devices either individually or in combination to remove contaminants from the print plate.

It has been found that the prior art printing press plate cleaning devices can cause print defects in the printed substrate. This problem is especially magnified when the cleaning device is used for on-line cleaning on a printing press utilizing segmented printing plates. As used herein, "segmented printing plates" refers to printing plates which are applied in separate sections across the width of the printing press. When printing with segmented printing plates, the clearance distance between the surface of the print plate and the bottom surface of the cleaning device generally needs to be higher than when printing with sleeved printing plates. While not wishing to be bound by theory, it is believed that because of the higher clearance distance requirement between the segmented print plate and the cleaning device it is more difficult to control the rebound angle of the spent cleaning fluid (i.e.; cleaning fluid plus any contaminants such as ink, fiber, etc. removed by the cleaning fluid) from the surface of the print plate to the cleaning device. Instead of rebounding back into the cleaning device, some of the spent cleaning fluid has a tendency to rebound onto the printed substrate. As a result, it is common to observe the formation of water streaks and drops on the printed substrate.

A further drawback of prior art printing plate cleaning devices relates to the entrapment of cleaning fluid into the cells comprising the individual print plate print elements as the fluid is being applied to the surface of the print plate. The cleaning device is unable to effectively remove the spent cleaning fluid that is trapped between individual print elements of the print plate resulting in the formation of streaks and spotting on the surface of the printed substrate.

Yet a further drawback of prior art cleaning devices appears to relate to the flow dynamics of these prior art devices. Prior art cleaning devices tend to have the propensity to form recirculation zones (i.e.; zones of eddy formation) within the collection areas of these devices. These zones can potentially interfere with the collection of the spent cleaning fluid thereby inhibiting the efficient removal of the spent fluid. The spent cleaning fluid is then free to fall back onto the surface of the print plate and/or the substrate after initially entering the cleaning apparatus. These recirculation zones can also cause the cleaning apparatus to plug.

The cleaning apparatus of the present invention addresses these drawbacks as it can be utilized at higher clearance distances without the formation of water streaks and drops on the printed substrate. Furthermore, the cleaning apparatus of the present invention penetrates the boundary layer of air associated with the surface to be cleaned resulting in efficient cleaning.

Yet further, the cleaning apparatus of the present invention is able to effectively remove spent cleaning fluid trapped between individual print elements of the print plate. Even yet further, the cleaning apparatus of the present invention minimizes recirculation zones within the device thereby providing more efficient collection of the spent cleaning fluid. In addition, the cleaning apparatus of the present invention tends to be self-cleaning. The benefits of the present invention include improved process efficiency and reliability.

SUMMARY OF THE INVENTION

The present invention relates to a cleaning apparatus. The cleaning apparatus comprises a plenum and a head connected to the plenum. The head includes: a nozzle, at least two banks of air jets wherein at least one bank of air jets is offset from a second bank of air jets and at least three vacuum ports. The nozzle may be positioned inside one of the vacuum ports. The head may also be positioned outboard of the vacuum ports. The local velocity within a substantial portion of the head and plenum is greater than the conveying velocity of the largest cleaning fluid droplet.

The cleaning apparatus may also include an aerodynamic surface. The aerodynamic surface may surround the interior surface of the cleaning apparatus. The aerodynamic surface may surround the interior of the head, the plenum, or a combination of both.

The cleaning apparatus includes at least one vacuum port and at least one bank of air jets. One or more of the vacuum ports may include a partition. The partition can separate the vacuum port from the bank of air jets. The partition can include a beveled edge. The beveled edge oriented in the upward direction of air flow. The beveled edge can comprise an angle of greater than about 0° but less than or equal to about 45°.

The cleaning apparatus can also optionally include an anti-plate stripping element.

DETAILED DESCRIPTION OF THE INVENTION

Figure 1:
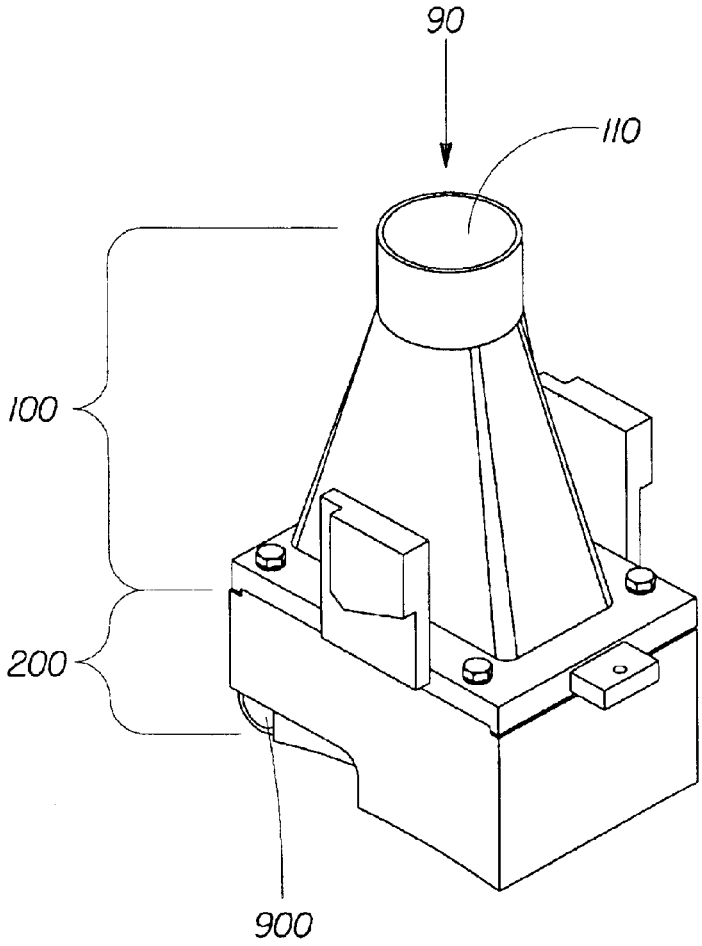
FIG. 1 is a perspective view of an embodiment of the cleaning apparatus of the present invention.

The apparatus of the present invention may be used in conjunction with any type of printing press print plate. Furthermore, the apparatus of the present invention may also be used in conjunction with other types of processes where it is desirable to clean the equipment either while the process is idle or while it is running. Non-limiting examples include rolls such as idler rolls, rolls with irregular surface topography, and rolls utilized in the papermaking and converting processes (i.e.; including but not limited to embossing, laminating, and the like).

With regard to printing images on textured substrates, the printing plate may produce a nonuniform print image due to irregularities on the surface of the substrate which remain unprinted. For example, papers that are embossed or have significant texture imparted by the drying fabric of the paper machine often create regions that cannot be adequately covered with ink. It is not unusual to observe ink, lint and other contaminants building up on printing plates when printing these types of papers. This is even more commonplace when the textured paper is an absorbent disposable paper product.

The apparatus of the present invention can be used in conjunction with any type of printing process. A non-limiting list of these printing processes include flexography, direct gravure, offset gravure, lithography, letterpress, and intaglio. Ink or fiber deposits on the printing apparatus can require manual intervention to remove. In particular, inks which include binders that are highly rub resistant tend to cause more print defects due to buildup on the printing plates. This becomes especially problematic when using a flexographic printing process. Significant manual intervention causes unacceptable costs to be associated with the process. Therefore, it is desirable to limit the amount of manual intervention needed to print reliably and consistently.

Cleaning Apparatus

While not wishing to be bound by theory, it is believed that the cleaning apparatus 90 of the present invention provides three basic functions: a cleaning medium, a drying medium, and a removal medium. The cleaning medium includes a means for applying a cleaning fluid to the surface that is to be cleaned. The drying medium includes a means for drying the surface that has been contacted by the cleaning fluid. The removal medium includes a means for removing the spent cleaning fluid along with the contaminants from the surface that has been cleaned. If desired, the cleaning apparatus 90 may be indexed across a surface.

Referring to FIGS. 1, 2, and 5–7, the cleaning apparatus 90 of the present invention is comprised of a plenum 100 connected to a head 200. The head 200 includes a nozzle 400, a plurality of air jets, and one or more vacuum ports 700. Optionally, the cleaning apparatus 90 can include one or more aerodynamic surfaces 800.

Nozzle

The main purpose of the nozzle 400 is to convey a cleaning fluid to a surface. It is generally preferred that the nozzle 400 utilized for this purpose allow for the penetration of the cleaning fluid through the air boundary layer surrounding the surface. The nozzle 400 is connected to an external cleaning fluid source (not shown). Any cleaning fluid can be used including but not limited to water, detergents, solvents, and the like. The nozzle 400 can be internally placed within the head 200 as shown in the embodiment depicted in FIGS. 1, 3, and 5. The nozzle 400 may also be external to the head 200 as shown in the embodiment depicted in FIGS. 2, 4, and 6. In addition, it is conceivable that the cleaning apparatus 90 of the present invention could include both an external nozzle and an internal nozzle (not shown). Furthermore, it is also conceivable that the cleaning apparatus 90 of the present invention could include multiple internal nozzles, multiple external nozzles, or combinations thereof (not shown).

Nozzles 400 which produce a flat spray pattern are generally preferred, though other types of spray patterns may also be used. Generally, the nozzle 400 should be capable of delivering the cleaning fluid at a pressure of at least about 40 psi (2.8 kg/cm$^2$) of cleaning fluid. It should be understood however, that this number can be higher or lower depending upon the specific application. The angular relationship between the nozzle 400 and the surface to be cleaned should be such that the impingement angle of the cleaning fluid from the cleaning apparatus 90 to the surface provides effective removal of contaminants and the rebound angle of the spent cleaning fluid from the cleaned surface to the cleaning apparatus 90 is directed toward the vacuum ports 700.

Figure 3:
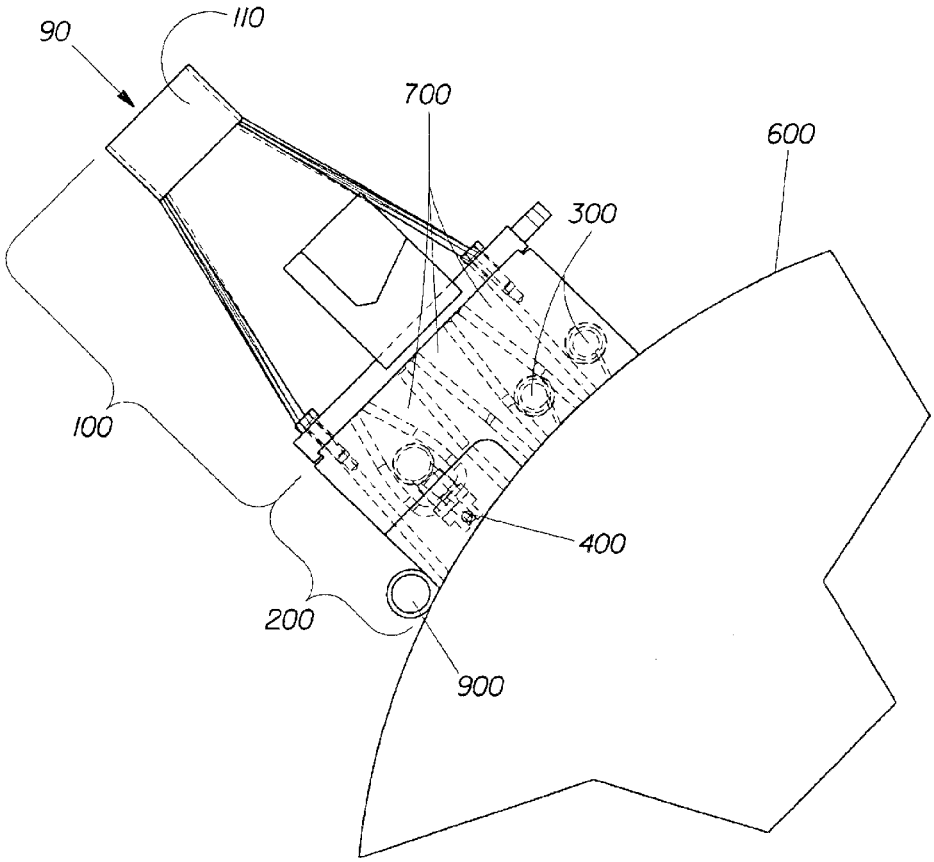
FIG. 3 is a front view of the cleaning apparatus embodiment of FIG. 1 depicted as it would be used to clean the plate cylinder of a printing press.

With regard to the internal nozzle 400 shown in FIG. 1, if the nozzle 400 is used to clean a moving surface, the placement of the nozzle 400 may be located such that the cleaning fluid contacts the surface to be cleaned counter to the direction of movement of the surface. The angular relationship between the nozzle 400 and the surface to be cleaned as measured in the direction relative to the normal of the surface to be cleaned is generally from about −6° to about 12° wherein an angle of 0° is normal to the surface, and a positive angle denotes orientation with the direction of the moving surface to be cleaned. This is illustrated in FIG. 3. Referring to FIG. 3, the cleaning apparatus 90 of the present invention is shown as used in operation for cleaning a plate cylinder of a printing press.

Figure 2:
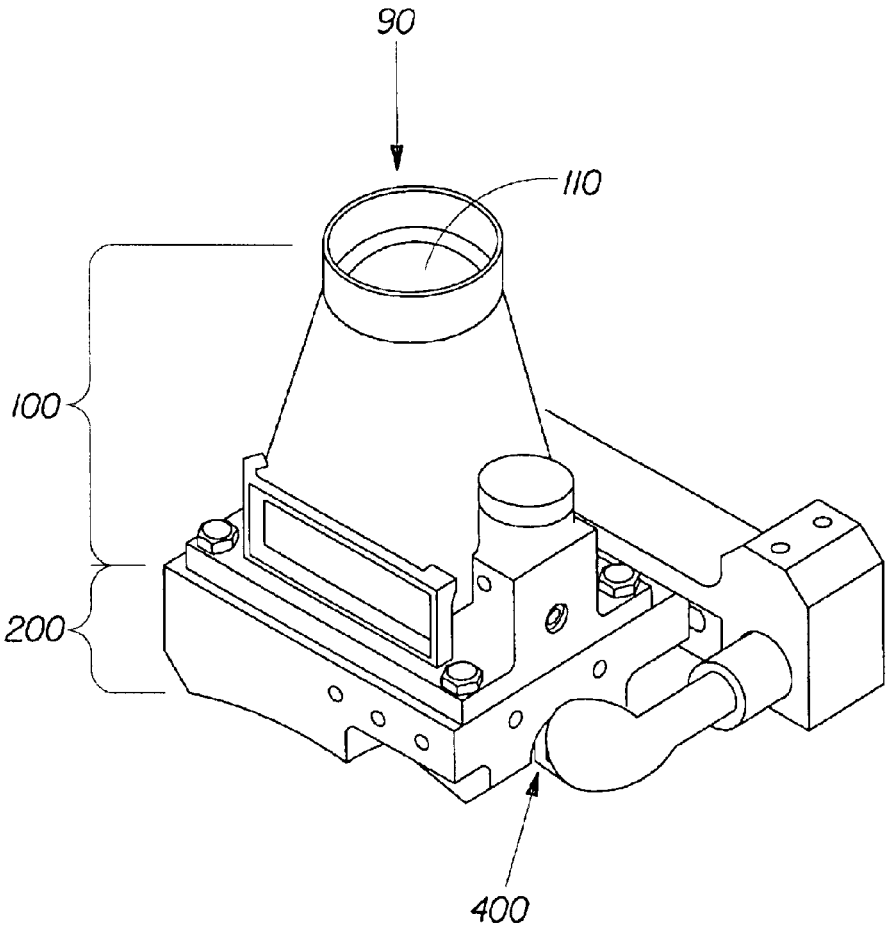
FIG. 2 is a perspective view of a second embodiment of the cleaning apparatus of the present invention.
Figure 4:
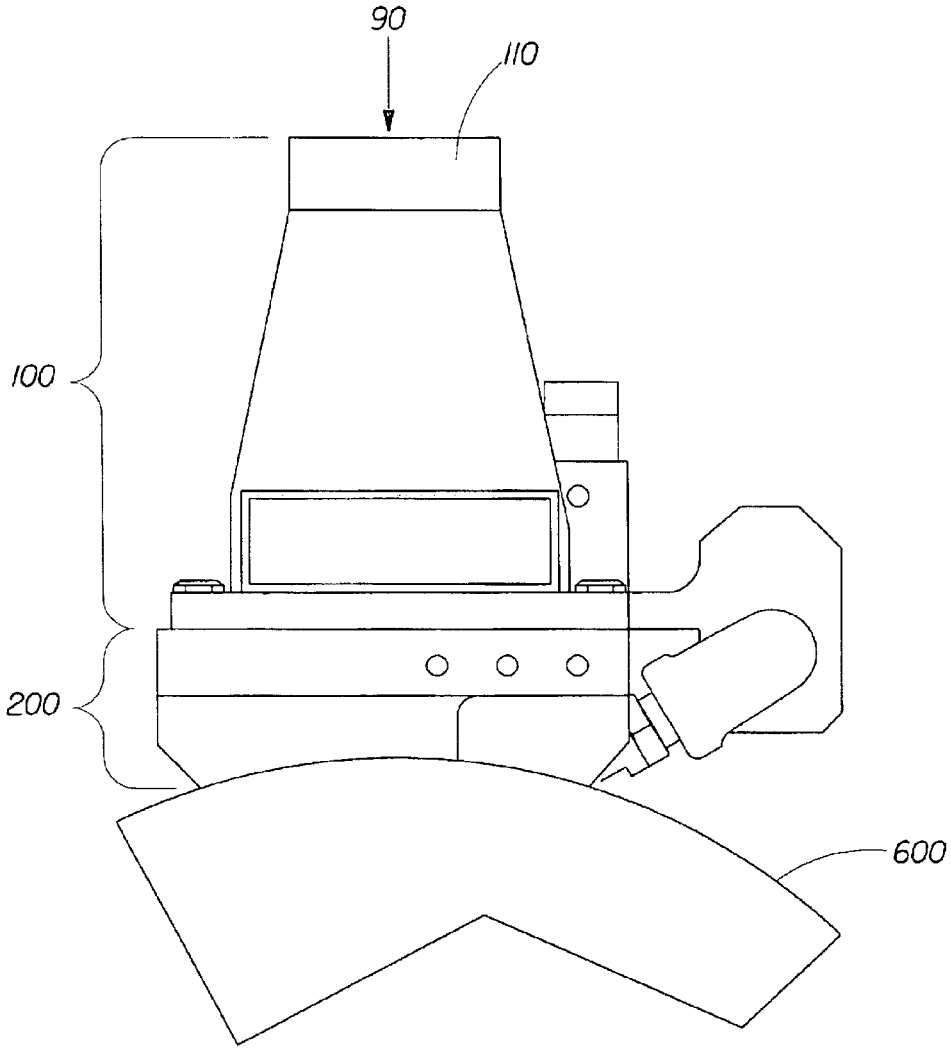
FIG. 4 is a front view of the cleaning apparatus embodiment of FIG. 2 depicted as it would be used to clean the plate cylinder of a printing press.

With regard to the external nozzle 400 shown in FIG. 2, if the nozzle 400 is used to clean a moving surface, the placement of the nozzle 400 may be located such that it the cleaning fluid contacts the surface to be cleaned in the same direction as the movement of the surface. The angular relationship between the nozzle 400 and the surface to be cleaned as measured in the direction relative to the normal of the surface to be cleaned is generally from about −25° to about −75°, preferably about −35° to about −55°, and most preferably about −40° to about −50°, wherein an angle of 0° is normal to the surface to be cleaned. This is illustrated in FIG. 4. Referring to FIG. 4, the cleaning apparatus 90 of the present invention is shown as used in operation for cleaning a plate cylinder of a printing press.

A non-limiting example of a suitable nozzle 400 which may be used with the present invention is the VeeJet® Flat Spray Nozzle having an orifice diameter of 0.021 inches (0.533 mm), Part No. H1/8VV 150067, available from Spraying Systems Company of Wheaton, Ill.

Air Jets

While not wishing to be bound by theory, it is believed that the air jets assist with the disruption and penetration of the air boundary layer surrounding the surface to be cleaned. It is also believed that the air jets assist in placing contaminants in suspension with the cleaning fluid thereby facilitating their removal from the surface. Additionally, it is thought that the air jets facilitate the drying of the surface after the cleaning fluid has been applied to the surface.

Figure 5:
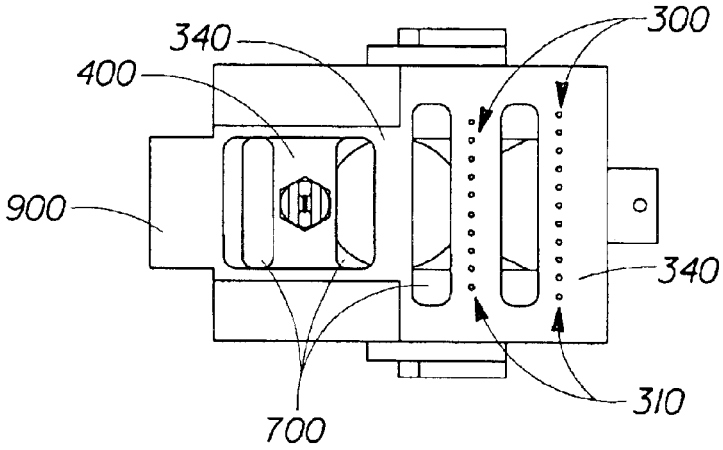
FIG. 5 is a bottom view of the cleaning apparatus embodiment of FIG. 1.
Figure 6:
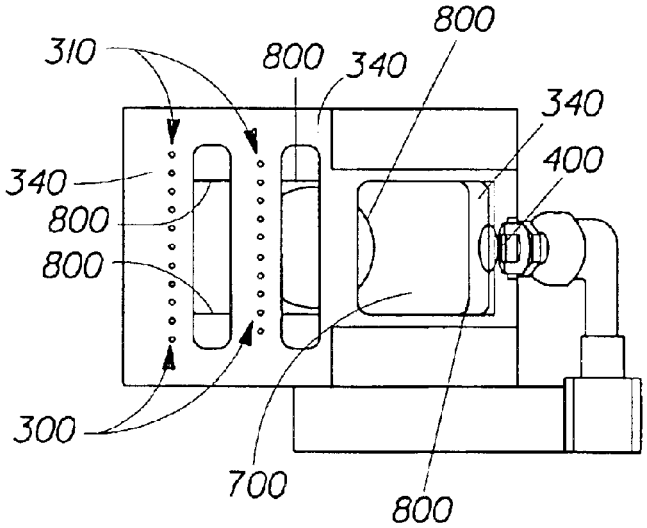
FIG. 6 is a bottom view of the cleaning apparatus embodiment of FIG. 2.
Figure 7:
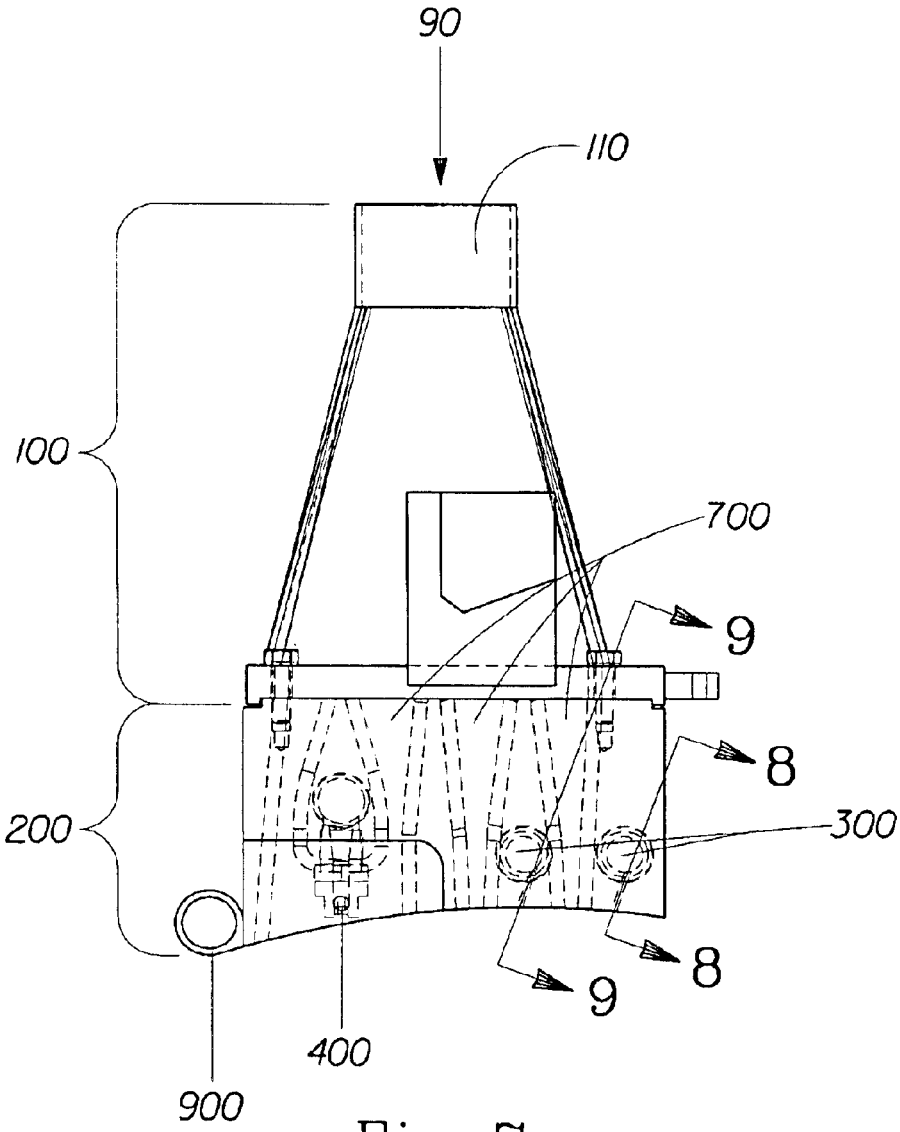
FIG. 7 is a front view of the cleaning apparatus embodiment of FIG. 1.

The air jets, which are connected to an external air source (not shown), are comprised of a plurality of orifices as shown in FIGS. 5 and 6. Though one bank 310 of air jets 300 may be used, it is generally preferred to have at least two banks 310 of air jets 300. There are a number of ways in which the air jets may be configured. A non-limiting example of one configuration is shown in FIGS. 5 and 6. Referring to FIGS. 5 and 6, the number of orifices in one air bank 310 contains one additional air jet 300 as compared to the other air bank 310. With the exception of the center air jet 300, the air jets 300 in the air bank 310 containing the additional air jet 300 are offset approximately ½ pitch from the corresponding air jets 300 in the other air bank 310 as shown in FIGS. 5 and 6. While not wishing to be limited by theory, it is believed that this staggered configuration between the banks 310 of air jets 300 provides improved coverage of the surface to be cleaned and also facilitates directing the removal of the spent cleaning fluid into the cleaning apparatus 90.

Figure 8:
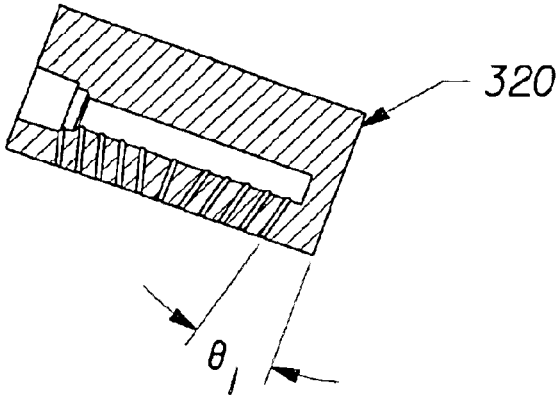
FIG. 8 is a cross-sectional view of FIG. 7 taken along lines 8—8 of FIG. 7.
Figure 9:
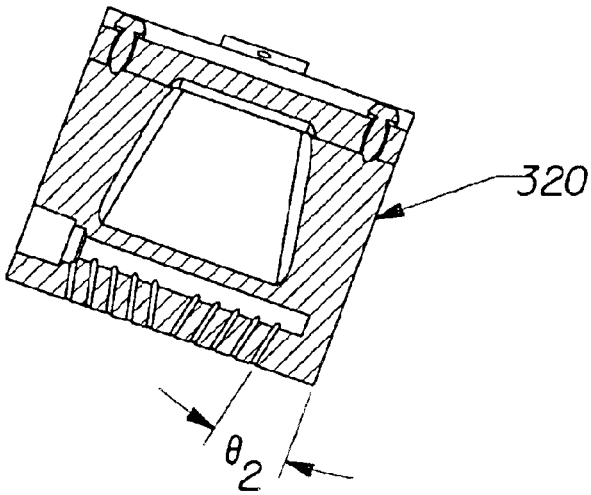
FIG. 9 is a cross-sectional view of FIG. 7 taken along lines 9—9 of FIG. 7.
Figure 10:
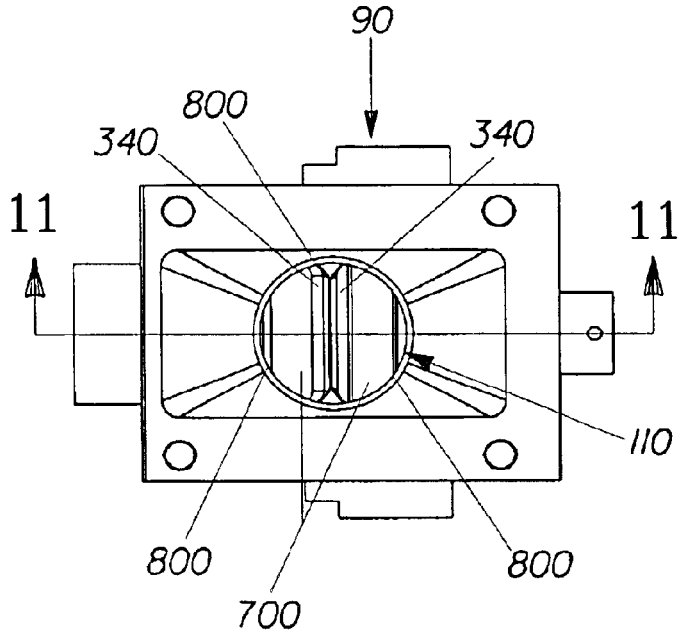
FIG. 10 is a top view of the cleaning apparatus embodiment of FIG. 1.
Figure 11:
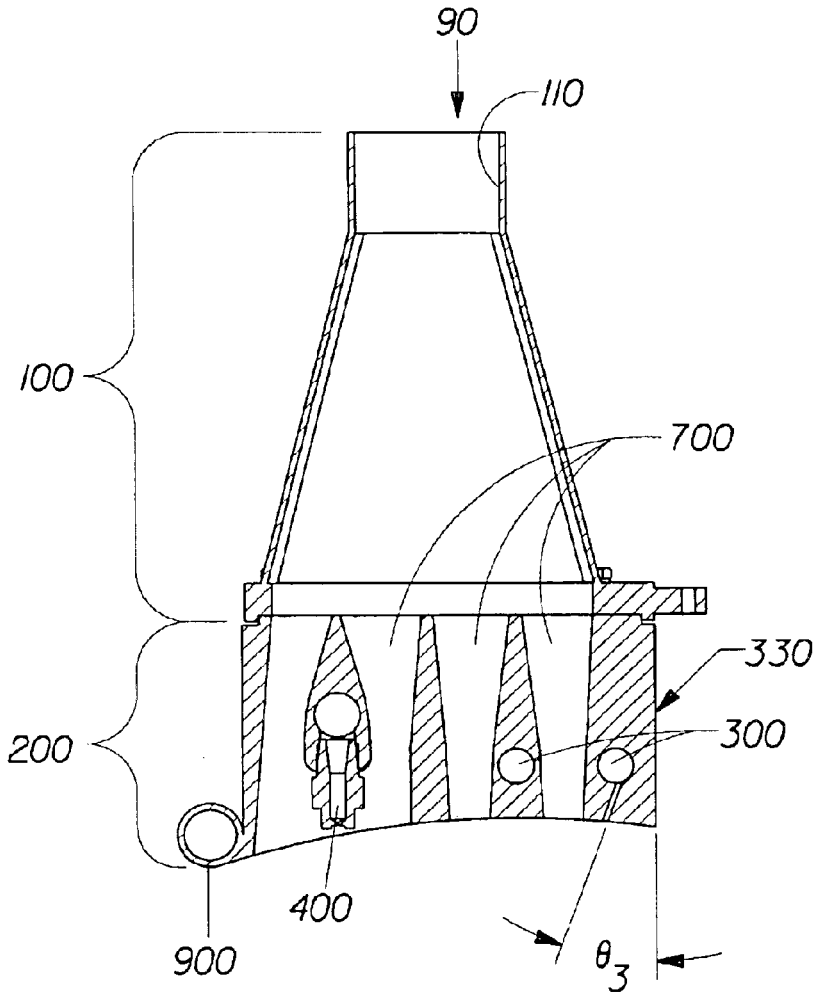
FIG. 11 is a cross-sectional view of FIG. 10 taken along lines 11—11 of FIG. 10.

With respect to their orientation within the cleaning apparatus 90, the individual air jets 300 may be configured at an angle if desired. One non-limiting example of such a configuration is shown in FIGS. 7–11. Referring to FIG. 8, with the angle $\theta_1$ relates to the angular relationship of the individual air jets 300 with plane D 320. Though angle $\theta_1$ can be any suitable angle obvious to one of skill in the art, a non-limiting suitable range for angle $\theta_1$ is from about 0° to 60°. Referring to FIG. 9, angle $\theta_2$ relates to the angular relationship of the individual air jets 300 with plane D 320. Though angle $\theta_2$ can be any suitable angle obvious to one of skill in the art, a non-limiting suitable range for angle $\theta_2$ is from about 0° to 60°. Referring to FIG. 11, angle $\theta_3$ relates to the angular relationship of the individual air jets 300 with plane B 330. Though angle $\theta_3$ can be any suitable angle obvious to one of skill in the art, a non-limiting suitable range for angle $\theta_3$ is from about 0° to 60°.

A non-limiting example of suitable orifice diameters for an individual air jet 300 may range from about 0.020 inches (0.508 mm) to about 0.125 inches (3.175 mm) and preferably from about 0.045 inches (1.143 mm) to about 0.055 inches (1.397 mm) though smaller or larger orifice diameters may be used. Suitable air pressure to the air jets 300 is generally at least about 45 psi (3.2 kg/cm$^2$). However, it should be understood that more or less air may be needed depending upon the specific application.

Vacuum Ports

The main purpose of the vacuum ports 700 is to remove the spent cleaning fluid from a surface that has been cleaned. The vacuum ports 700 provide a conduit for the spent cleaning fluid to travel from the cleaned surface through the head 200 and plenum 100 to an external removal location.

Though a unitary vacuum port may be used, it is generally preferred to have at least two vacuum ports 700 and more preferably at least three vacuum ports 700. The vacuum ports 700 may be in any form including but not limited to slots, slits, or any other form familiar to those of ordinary skill in the art. Referring to FIGS. 3, 5–7, and 10–11, an embodiment of the cleaning apparatus 90 of the present invention is shown having three vacuum ports 700. The vacuum ports 700 may be placed in any configuration suitable for removing spent cleaning fluid from the cleaned surface. One suitable configuration is shown in FIG. 5 wherein two vacuum ports 700 are each placed adjacent to a bank 310 of air jets 300. The third vacuum port is adjacent to one of these two vacuum ports 700. The nozzle 400 is positioned inside the third vacuum port.

Another suitable configuration is shown in FIG. 6 wherein two vacuum ports 700 are each placed adjacent to a bank 310 of air jet 300. The third vacuum port is adjacent to one these two vacuum ports 700. The nozzle 400 is positioned outboard of the third vacuum port. Generally, a minimum vacuum flow is needed to prevent the spent cleaning fluid from dripping onto the cleaned surface. A non-limiting example of a suitable minimum vacuum flow for cleaning a print plate wherein the clearance between the bottom of the head 200 of the cleaning apparatus 90 and the top surface of the print plate is approximately 0.130 inches (3.3 mm) is generally at least about 70 SCFM (1.8 SCMM). This is based on the use of the aforementioned nozzle and a head 200 whose open face area is about 3.4 inches$^2$ (21.94 cm$^2$).

Plenum

The plenum 100 provides a vacuum conduit that facilitates the removal of the spent cleaning fluid from the surface that has been cleaned. Though the plenum 100 may be comprised of more than one chamber 110, a single chamber 110 is generally preferred as shown in FIGS. 1–4, 7, and 11. While not wishing to be bound by theory, it is thought that a plenum 100 having a single chamber 110 helps reduce recirculation zones within the plenum 100 thereby improving the flow dynamics of the cleaning apparatus 90 as compared to a plenum 100 having two or more chambers 110. The plenum 100 is connected to an external vacuum source (not shown).

Anti-Plate Stripping Element

The cleaning apparatus 90 of the present invention may optionally include an anti-plate stripping element 900. A non-limiting instance where it may be desirable to utilize the anti-plate stripping element 900 is when utilizing the cleaning apparatus 90 to clean segmented print plates. Segmented print plates, familiar to those of ordinary skill in the art, are magnetically or otherwise attached to the print cylinder. The anti-plate stripping element 900 can be utilized to prevent the print plate from lifting off the print cylinder. The anti-plate stripping element 900 may be comprised of any material or shape so long as it is capable of creating a downward force to push a print plate back into place on the print cylinder. A suitable anti-plate stripping element 900 is shown in FIGS. 1, 3, and 5.

Flow Dynamics

It is desirable to minimize the formation of recirculation zones within the cleaning apparatus 90. As described herein, recirculation zones refer to zones of eddy or whirlpool formation. While not wishing to be bound by theory, it is believed that these zones have a deleterious impact on the cleaning and removal process as there is a reduction in the upward velocity in these areas. This can result in the spent cleaning fluid dropping back onto the clean surface or the substrate. Additionally, it can result in the plugging of the cleaning apparatus 90 because it provides airborne contaminants the opportunity to stick to the wall of the apparatus thereby greatly reducing the process efficiency and quality of product. The minimization of eddy formation can actually facilitate the self-cleaning ability of the cleaning apparatus 90. In order to prevent this from occurring, it is desirable that the in-plane velocity of the vacuum at any point should remain above the droplet conveying velocity. The conveying velocity may be calculated as follows. The required conveying velocity is equal to the terminal falling velocity of a droplet of cleaning fluid. This is found by the equation:

$$V^2=2W/p_fAC_D$$

where V=velocity, W=droplet weight, $p_f$=density of the bulk fluid, A=droplet cross-sectional area and $C_D$=friction coefficient of the falling droplet (i.e.; drag coefficient). $C_D$ can be found in fluid dynamic handbooks such as the "*Applied Fluid Dynamics Handbook*", edited by Blevins, 1992 edition, pages 332 and 338. As used herein, "bulk fluid" refers to the fluid that is the predominant fluid within the cleaning apparatus 90. The bulk fluid is typically air.

Therefore, for a spherical droplet the equation becomes:

$$V^2 = \frac{8\,rgp_d}{3p_fC_D}$$

where g=gravitational acceleration, $P_d$=droplet density, and r=droplet radius. Assuming that the cleaning fluid has a mean drop size of 450 $\mu$m, the conveying velocity of the droplet is 2.0 m/s. Hence based on cleaning fluids having a mean drop size of 450 $\mu$m it is desirable that the local velocity within a substantial portion of the head 200 and plenum 100 be greater than about 2.0 m/s. The current invention is able to achieve this with a much lower vacuum flowrate than the prior art. As used herein, "local velocity", refers to the velocity at any specific point.

Aerodynamic Surface

One or more aerodynamic surfaces 800 may be used to minimize the formation of recirculation zones. The aerodynamic surface may be placed in any area within the plenum 100 or head 200. The aerodynamic surface 800 may comprise any type of medium which facilitates prevention of eddy formation. For instance, one non-limiting example of a suitable aerodynamic surface is a beveled or tapered edge in the head 200 and/or the plenum 100 which is tapered in the direction of vacuum flow smoothly combining the flow streams. In addition this beveled edge could also be used between the various chambers 110 of the cleaning apparatus 90. For instance, the beveled edge could be utilized on the interior walls of the partitions 340 which separate the vacuum ports 700 from the banks 310 of air jets 300. A non-limiting example of a suitable aerodynamic surface is shown in FIGS. 6 and 10. Referring to FIGS. 6 and 10 a beveled or tapered edge may be used around the interior surface of the head 200 and/or plenum 100. The beveled edge may comprise an angle less than or equal to about 45°, preferably an angle less than 40°, and most preferably an angle less than 15°.

EXAMPLES

Figure 12:
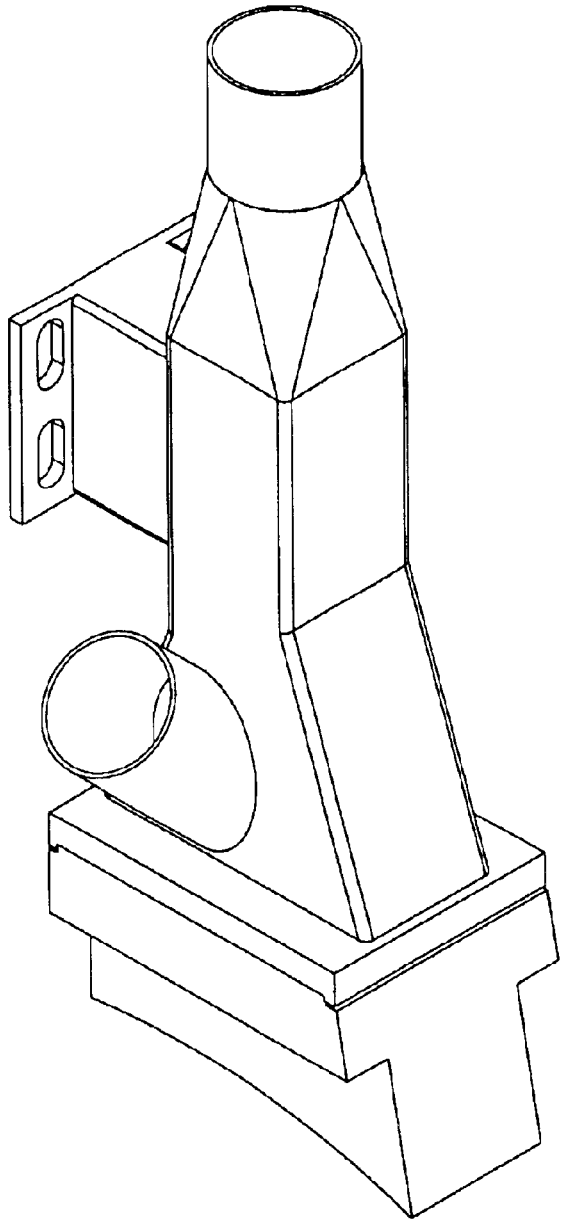
Fig. 12 PRIOR ART
FIG. 12 is a perspective view of a cleaning apparatus made according to the prior art.
Figure 13:
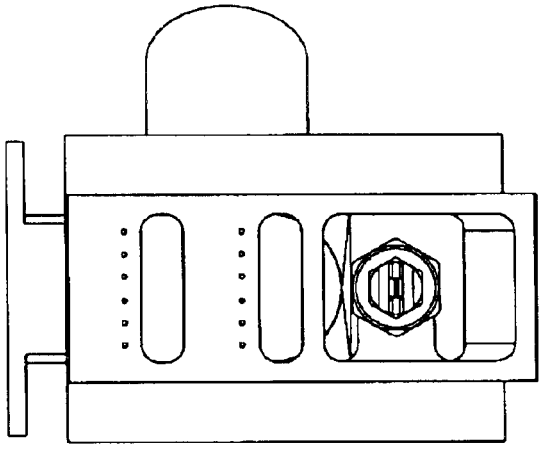
Fig. 13 PRIOR ART
FIG. 13 is a bottom view of the prior art cleaning apparatus of FIG. 12.

Two cleaning apparatus 90 embodiments made according to the present invention were compared to a prior art cleaning device for the purpose of cleaning print plates on a printing press. One of the embodiments made according to the present invention is described as Embodiment 1 as shown in FIGS. 1, 3, 5, and 7–11. The second embodiment made according to the present invention is described as Embodiment 2 as shown in FIGS. 2, 4, and 6. The prior art cleaning device, commercially available from the Fabio Perrini Company of Lucca, Italy, is shown in FIGS. 12 and 13. The parameters and comparison results are provided in Table 1, 2, and 3. For purposes of the comparisons, the particular cleaning apparatus being evaluated was positioned above a plate cylinder of the printing press.

The apparatus was mounted on a traversing mechanism such that it could freely traverse back and forth parallel to the axis of rotation of the plate cylinder in a manner similar to that shown in FIG. 3 (Embodiment 1) and FIG. 4 (Embodiment 2). The prior art device was similarly mounted on a traversing mechanism. During the comparison periods, the printing press was running at the speeds indicated in the tables below. Referring to FIG. 3, the angle of the nozzle 400 of Embodiment 1 with respect to the normal tangent of the plate cylinder was positive 12° wherein an angle of 0° was normal to the surface of the plate cylinder. The placement of the nozzle was such that the water contacting the surface of the plate cylinder was sprayed counter to the direction of rotation of the plate cylinder.

Referring to FIG. 4, the angle of the nozzle 400 of Embodiment 2 with respect to the normal tangent of the plate cylinder was −50°. The placement of the nozzle 400 of Embodiment 2 was such that the water contacting the surface of the plate cylinder was in the direction of the rotation of the plate cylinder.

Referring to FIGS. 3, 5, 7, 9, and 11 with respect to the angular relationship of the air jets 300, for both Embodiments 1 and 2, angle $\theta_1$ was 15°, angle $\theta_2$ was 12°, and angle $\theta_3$ was 20.

Referring to column 1, line 2 of Tables 1, 2, and 3, the type plate cylinder utilized on the printing press is indicated. The plate cylinder was either sleeved or segmented as indicated. Referring to column 1, line 3 of Tables 1, 2, and 3, the plate cylinder diameter is indicated. Referring to column 1, line 4 of Tables 1, 2, and 3, the speed of the printing press during the comparison period is indicated. Referring to column 1, line 5 of Tables 1, 2, and 3, the gap distance refers to the clearance distance between the bottom of the cleaning apparatus head and the surface of the print plate. Referring to column 1, line 6 of Tables 1, 2, and 3, water was utilized as the cleaning fluid. The approximate water pressure at the nozzle is indicated. Referring to column 1, line 7 of Tables 1, 2, and 3, the approximate pressure at the air jets is indicated. Referring to column 1, line 8 of Tables 1, 2, and 3, the approximate vacuum through the cleaning apparatus was noted. Referring to column 1, line 9 of Tables 1, 2, and 3, a visual observation was made as to whether water was dripping back onto the plate cylinder from the cleaning apparatus.

The tests indicate that the cleaning apparatus embodiments of the present invention allow for lower vacuum flows without water dripping back onto the plate cylinder as compared to the prior art cleaning device.

TABLE 1

| | Prior Art | Prior Art | Prior Art |
|---|---|---|---|
| Type Plate Cylinder | Sleeved | Sleeved | Segmented |
| Plate Cylinder Diameter | 9.75 inches (24.77 cm) | 9.75 inches (24.77 cm) | 17.83 inches (45.28 cm) |
| Printer Speed | 1600 fpm (487.68 mpm) | 1600 fpm (487.68 mpm) | 1100 fpm (335.28 mpm) |

TABLE 1-continued

| | Prior Art | Prior Art | Prior Art |
|---|---|---|---|
| Gap Distance | 0.130 inches (3.30 mm) | 0.130 inches (3.30 mm) | 0.130 inches (3.30 mm) |
| Approximate Nozzle Water Pressure | 500 psi (35.153 kg/cm$^2$) | 500 psi (35.153 kg/cm$^2$) | 500 psi (35.153 kg/cm$^2$) |
| Approximate Air Jet Pressure | 65 psi (4.570 kg/cm$^2$) | 65 psi (4.570 kg/cm$^2$) | 65 psi (4.570 kg/cm$^2$) |
| Approximate Vacuum | 203 SCFM (5.75 SCMM) | 75 SCFM (2.12 SCFM) | >168 SCFM (>5.03 SCMM) |
| Water Dripping | No | Yes | Yes |

TABLE 2

| | Embodiment 1 of the Present Invention | | | | |
|---|---|---|---|---|---|
| | Embodiment 1 | Embodiment 1 | Embodiment 1 | Embodiment 1 | Embodiment 1 |
| Type Plate Cylinder | Sleeved | Sleeved | Sleeved | Sleeved | Segmented |
| Plate Cylinder Diameter | 9.75 inches (24.77 cm) | 9.75 inches (24.77 cm) | 9.75 inches (24.77 cm) | 9.75 inches (24.77 cm) | 17.83 inches (45.28 cm) |
| Printer Speed | 1600 fpm (487.68 mpm) | 1600 fpm (487.68 mpm) | 1600 fpm (487.68 mpm) | 1600 fpm (487.68 mpm) | 1550 fpm (472.44 mpm) |
| Gap Distance | 0.130 inches (3.30 mm) | 0.130 inches (3.30 mm) | 0.130 inches (3.30 mm) | 0.130 inches (3.30 mm) | 0.130 inches (3.30 mm) |
| Approximate Nozzle Water Pressure | 500 psi (35.153 kg/cm$^2$) | 500 psi (35.153 kg/cm$^2$) | 500 psi (35.153 kg/cm$^2$) | 500 psi (35.153 kg/cm$^2$) | 500 psi (35.153 kg/cm$^2$) |
| Approximate Air Jet Pressure | 45 psi (3.164 kg/cm$^2$) | 45 psi (3.164 kg/cm$^2$) | 45 (3.164 kg/cm$^2$) | 45 psi (3.164 kg/cm$^2$) | 45 psi (3.164 kg/cm$^2$) |
| Approximate Vacuum | 163.6 SCFM (4.63 SCMM) | 114.7 SCFM (3.25 SCMM | 82.4 SCFM (2.33 SCMM) | 57.7 SCFM (1.63 SCMM) | 122.5 SCFM (3.47 SCCM) |
| Water Dripping | No | No | No | Yes | No |

*VeeJet ® Flat Spray Nozzle having an orifice diameter of 0.021 inches (0.533 mm), Part No. H1/8VV 150067, available from Spraying Systems Company of Wheaton, Illinois.

TABLE 3

| | Embodiment 2 of the Present Invention | | | | |
|---|---|---|---|---|---|
| | Embodiment 2 | Embodiment 2 | Embodiment 2 | Embodiment 2 | Embodiment 2 |
| Type Plate Cylinder | Sleeved | Sleeved | Sleeved | Sleeved | Sleeved |
| Plate Cylinder Diameter | 9.75 inches (24.77 cm) | 9.75 inches (24.77 cm) | 9.75 inches (24.77 cm) | 9.75 inches (24.77 cm) | 9.75 inches (24.77 cm) |
| Printer Speed | 1600 fpm (487.68 mpm) | 1600 fpm (487.68 mpm) | 1600 fpm (487.68 mpm) | 1600 fpm (487.68 mpm) | 1600 fpm (487/68 mpm) |
| Gap Distance | 0.130 inches (3.30 mm) | 0.130 inches (3.30 mm) | 0.130 inches (3.30 mm) | 0.130 inches (3.30 mm) | 0.130 inches (3.30 mm) |
| Approximate Nozzle Water Pressure | 500 psi (35.153 kg/cm$^2$) | 500 psi (35.153 kg/cm$^2$) | 500 psi (35.153 kg/cm$^2$) | 500 psi (35.153 kg/cm$^2$) | 500 psi (35.153 kg/cm$^2$) |
| Approximate | 45 psi | 45 psi | 45 psi | 45 psi | 45 psi |

TABLE 3-continued

| | Embodiment 2 of the Present Invention | | | | |
|---|---|---|---|---|---|
| | Embodiment 2 | Embodiment 2 | Embodiment 2 | Embodiment 2 | Embodiment 2 |
| Air Jet Pressure | (3.164 kg/cm$^2$) | (3.164 kg/cm$^2$) | (3.164 kg/cm$^2$) | (3.164 kg/cm$^2$) | (3.164 kg/cm$^2$) |
| Approximate Vacuum | 174.5 SCFM (4.94 SCMM) | 108.9 SCFM (3.08 SCMM | 78.3 SCFM (2.22 SCMM) | 66.2 SCFM (1.87 SCMM) | 54.2 SCFM (1.54 SCMM) |
| Water Dripping | No | No | No | No | Yes |

*VeeJet ® Flat Spray Nozzle having an orifice diameter of 0.021 inches (0.533 mm), Part No. H1/8VV 150067, available from Spraying Systems Company of Wheaton, Illinois.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning apparatus, said apparatus comprising:

a) a plenum;

b) a head connected to said plenum said head including:

i) a nozzle;

ii) at least two banks of air jets wherein at least one bank of air jets is offset from a second bank of air jets; and iii) at least three vacuum ports wherein at least one of said three vacuum ports includes a partition, said partition separating said vacuum port from at least one of said two banks of air jets, said partition including a beveled edge, said beveled edge oriented in the upward direction of air flow, wherein said beveled edge comprises an angle of less than about 45° from the surface of the partition.

2. The cleaning apparatus of claim 1 wherein said nozzle is positioned inside one of said vacuum ports.

3. The cleaning apparatus of claim 1 wherein said nozzle is positioned outboard of said vacuum ports.

4. The cleaning apparatus of claim 1 wherein the local velocity within a substantial portion of said head and said plenum is greater than about 2.0 m/s for a cleaning fluid droplet size of 450 $\mu$m.

5. The cleaning apparatus of claim 1 further comprising an aerodynamic surface which comprises the interior surface of said cleaning apparatus.

6. The cleaning apparatus of claim 5 wherein said aerodynamic surface comprises the interior surface of said plenum.

7. The cleaning apparatus of claim 5 wherein said aerodynamic surface comprises the interior surface of said head.

8. The cleaning apparatus of claim 1 further comprising an anti-plate stripping element.

9. The cleaning apparatus of claim 1 wherein said beveled edge comprises an angle of less than about 15° from the surface of the partition.

10. A cleaning apparatus, said apparatus comprising:

a) a plenum;

b) a head connected to said plenum said head including:

i) a nozzle;

ii) at least two banks of air jets wherein at least one bank of air jets is offset from a second bank of air jets; and iii) at least three vacuum ports wherein each of said vacuum ports is separated by a partition, said partition extending upwardly from the bottom of said head, and wherein said partition includes a beveled edge oriented upwardly in the upward direction of air flow through said head, said beveled edge comprising an angle less than or equal to about 45° from the surface of the partition, and wherein:

a cleaning fluid comprising droplets each having a conveying velocity is conveyed from the nozzle; and a vacuum is applied to the cleaning apparatus yielding a vacuum flow rate of between about 66 SCFM and about 168 SCFM, the vacuum flow rate yielding a local velocity that is greater than substantially all of the droplet conveying velocities.

11. A cleaning apparatus, said apparatus comprising:

a) a plenum;

b) a head connected to said plenum said head including:

i) a nozzle;

ii) at least two banks of air jets wherein at least one bank of air jets is offset from a second bank of air jets;

iii) at least three vacuum ports wherein each of said vacuum ports is separated by a partition, said partition extending upwardly from the bottom of said head, and wherein said partition includes a beveled edge oriented upwardly in the upward direction of air flow through said head, said beveled edge comprising an angle less than or equal to about 45° from the surface of the partition; and iv) an aerodynamic surface, wherein: a cleaning fluid comprising droplets each having a conveying velocity is conveyed from the nozzle; and a vacuum is applied to the cleaning apparatus yielding a vacuum flow rate of between about 66 SCFM and about 168 SCFM, the vacuum flow rate yielding a local velocity that is greater than substantially all of the droplet conveying velocities.

12. The cleaning apparatus of claim 11 having two banks of air jets wherein one bank of air jets includes one more air jet than said second bank of air jets.

13. The cleaning apparatus of claim 11 having two banks of air jets wherein one bank of air jets is offset by one-half pitch from the second bank of air jets.

14. The cleaning apparatus of claim 11 wherein said nozzle is positioned inside one of said vacuum ports and wherein the angular relationship between said nozzle and a surface to be cleaned is about −6° to 12°.

15. The cleaning apparatus of claim 11 wherein said nozzle is outboard of said vacuum ports.

16. The cleaning apparatus of claim 15 wherein the angular relationship between said nozzle and a surface to be cleaned as measured in the direction relative to normal of the surface is about −25° to about −75°.

* * * * *